United States Patent [19]

Bates

[11] 4,204,773

[45] May 27, 1980

[54] MIXING MEANS

[75] Inventor: Leonard T. Bates, Maidstone, England

[73] Assignee: Winget Limited, Rochester, England

[21] Appl. No.: 879,886

[22] Filed: Feb. 21, 1978

[30] Foreign Application Priority Data

Feb. 18, 1977 [GB] United Kingdom ..... 07051/77

[51] Int. Cl.[2] ..... B28C 7/04

[52] U.S. Cl. ..... 366/18

[58] Field of Search ..... 366/16–21, 366/27, 29, 33, 8, 150–153, 160, 162

[56] References Cited

U.S. PATENT DOCUMENTS

| | | | |
|---|---|---|---|
| 3,110,421 | 11/1963 | Matthias | 366/18 X |
| 3,380,717 | 4/1968 | Adams et al. | 366/18 |
| 3,661,365 | 5/1972 | Cloud | 366/18 |
| 3,820,762 | 6/1974 | Bostrom et al. | 366/18 |
| 3,986,708 | 10/1976 | Heltzel et al. | 366/17 |
| 4,025,057 | 5/1977 | Shearer | 366/18 X |

*Primary Examiner*—John M. Jillions

*Attorney, Agent, or Firm*—Kemon & Estabrook

[57] ABSTRACT

A plant to produce concrete by mixing sand, cement, aggregate and water by a continuous operation. A plurality of storage hoppers with twin outlets associated with weigh hoppers permit a discharge of aggregate and sand material through vibratory feeders onto a conveyor belt so that one group of weigh hoppers discharges while a second group is being filled. The conveyor belt delivers in a continuous manner to a trough mixer which receives cement from a silo and water for mixing said ingredients.

1 Claim, 3 Drawing Figures

MIXING MEANS

This invention relates a mixing plant and, more particularly, to concrete mixing plant in which aggregate, sand, cement and water are mixed together to produce concrete.

According to the present invention there is provided a mixing plant including a series of pairs of weigh hoppers arranged to be charged from a multiplicity of materials supplies, the respective weigh hoppers of each pair alternately discharging at controlled rates through respective variable speed feeders to the inlet of a continuous mixer.

The invention will now be described, by way of example, with reference to the accompanying, partly diagrammatic drawings, in which.

Figure 1:
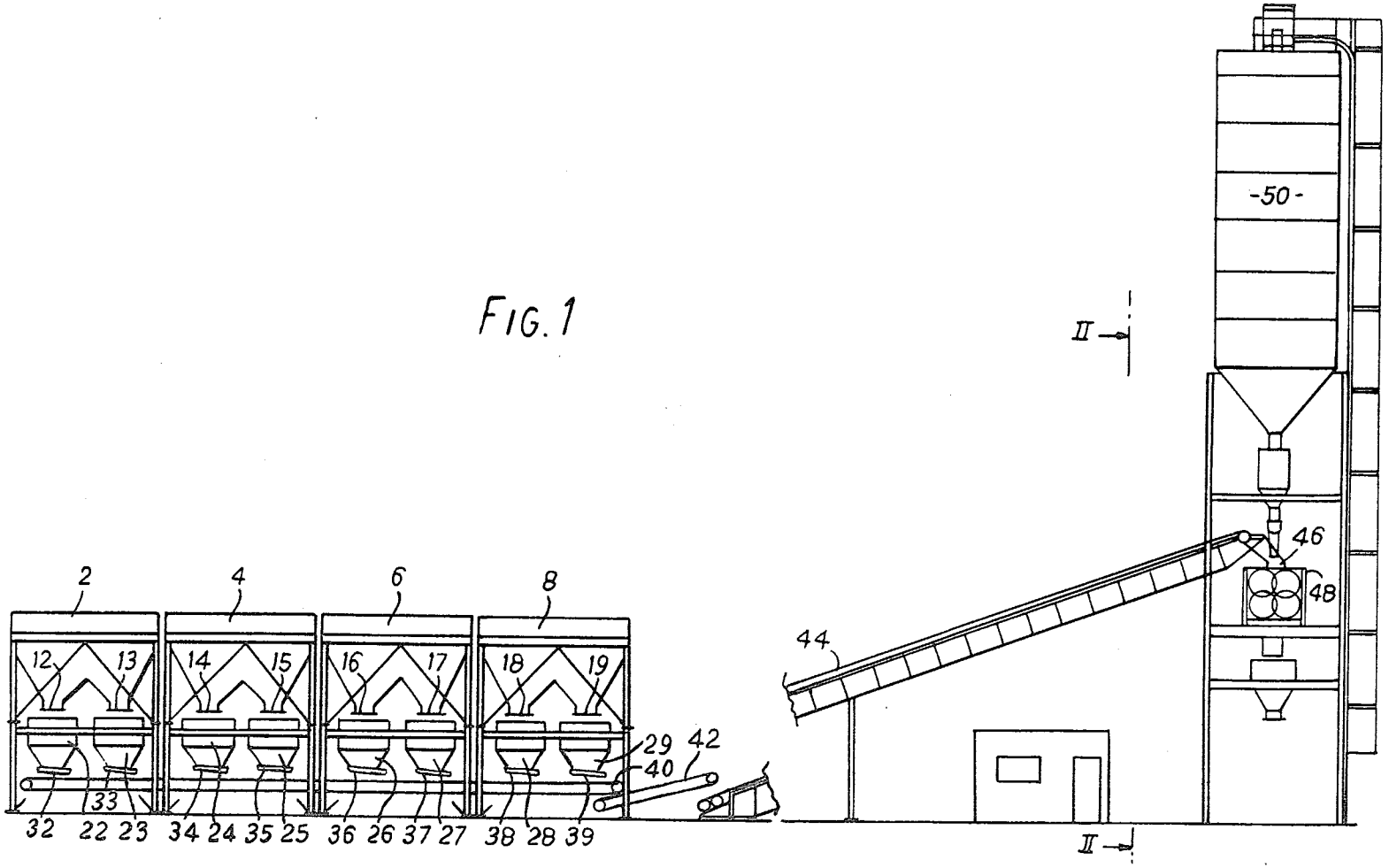
FIG. 1 is a side elevation of a concrete mixing plant.
Figure 2:
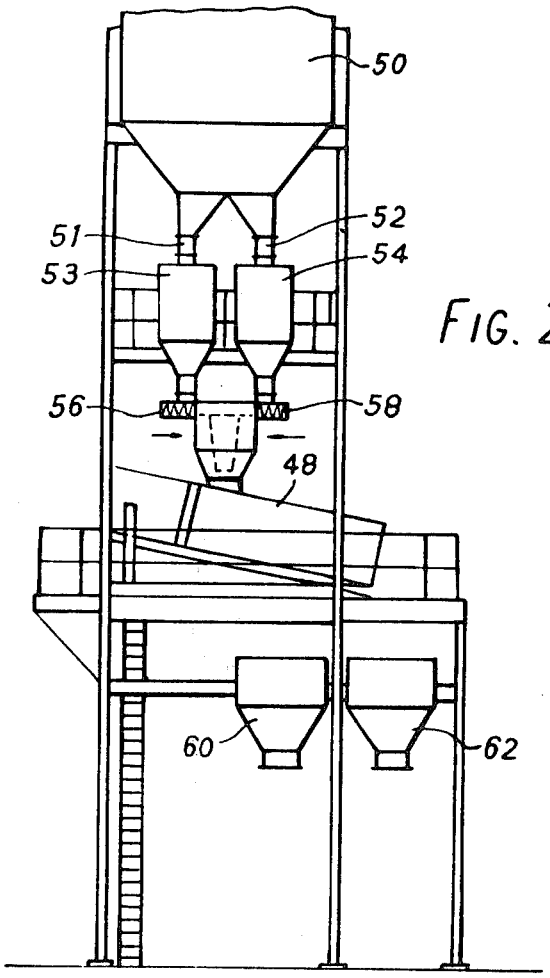
FIG. 2 is a sectional end elevation of the plant taken on the line II—II and omitting an upper portion of a cement silo.
Figure 3:
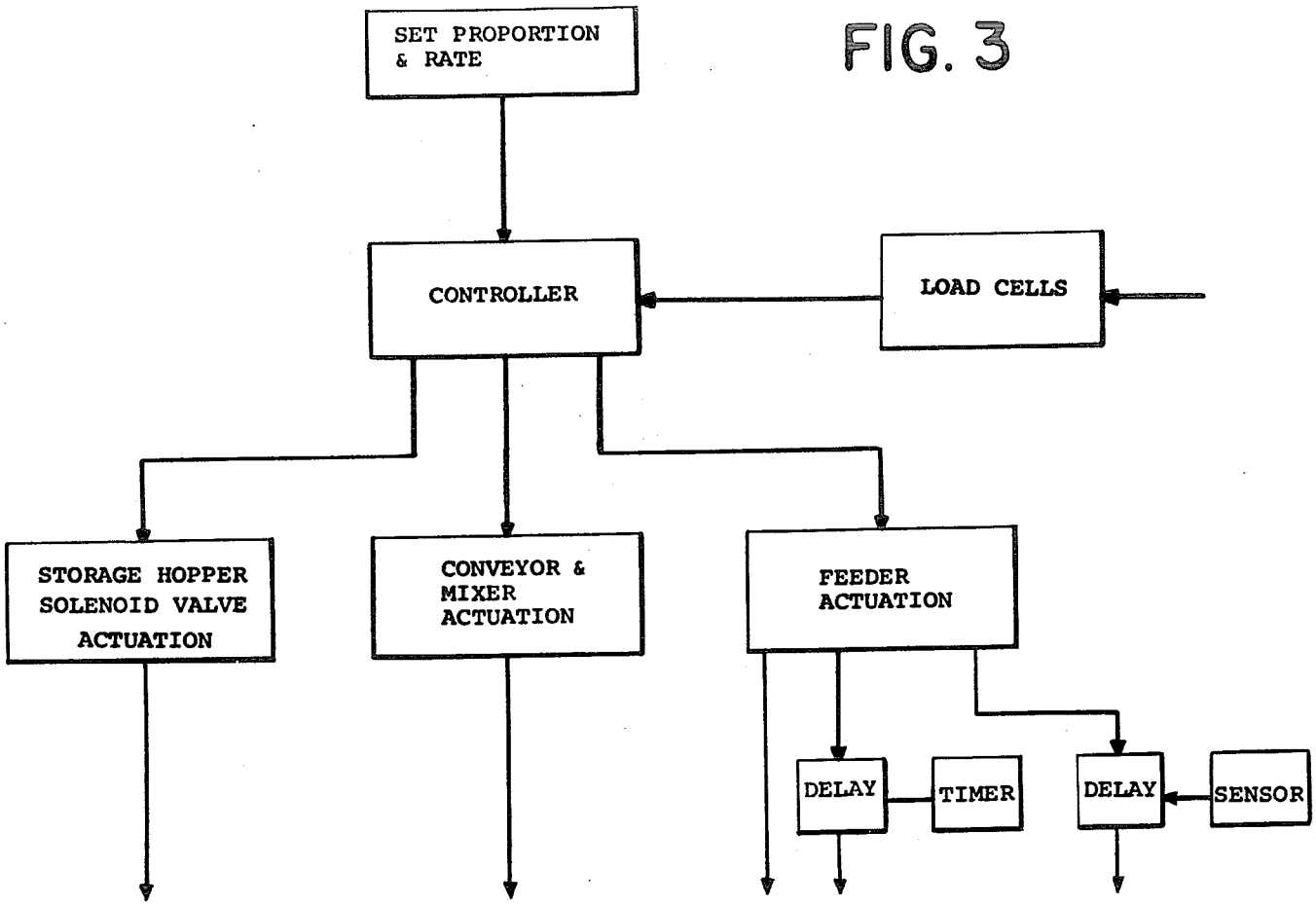
FIG. 3 is a block diagram of the control circuitry for the concrete mixing plant embodying the present invention.

Referring to the drawings, four, twin-outlet, storage hoppers 2, 4, 6, 8 having solenoid actuated bucket valves 12 to 19 respectively feed pairs of weigh hoppers 22 to 29 discharging through vibratory feeders 32 to 39 to a feed conveyor belt 40. The feed conveyor belt 40 discharges to a transfer belt 42 which, in turn, discharges to an elevator belt 44 discharging to the inlet 46 of a continuous trough mixer 48. A twin outlet cement silo 50 having solenoid actuated bucket valves 51, 52 feeds a pair of cement weigh hoppers 53, 54 discharging through respective variable speed screw feeders to the inlet 46 of the continuous trough mixer 48. Water is discharged to the inlet 46 of the continuous trough mixer 48, through a pair of water batchers (not shown). Discharge of concrete from the continuous trough mixer 48 is directed to one or other of a pair of elevated holding hoppers 60, 62 supplying, in due course, lorry mounted mixer transporters or other concrete transfer means (not shown).

Each weigh hopper 22 to 29 is mounted on a load cell system which respectively transmit signals indicating the mass of material within the associated weigh hopper to a controller. Signals are transmitted from the controller to effect actuation of the solenoids of the bucket valves 12 to 19 and 51, 52 and to effect regulation of the speed of the vibratory feeders 32 to 39 and screw feeders 56, 58 and the flow of water.

In operation, the three storage hoppers 2, 4, 6 are filled with aggregate, the fourth hopper 8 with sand, the cement silo 50 filled with cement and the water supply connected. A required volumetric recipe for mixing is adjusted to a weight recipe, the densities of the various materials having been determined previously, and is fed into the controller as a series of set points and signals are originated setting the appropriate speeds of the various conveyor belts 40, 42, 44 and feeders 32 to 39 and 56, 58 and the mixer 48 to give a required rate of delivery of concrete. Upon initiating a mixing operation, signals are transmitted from the controller effecting actuation of one of each of the pairs of solenoid actuated valves on each of the storage hoppers (12, 13; 14, 15; 16,17; 18,19) and on the cement silo (51, 52) and water supply (not shown). The conveyor belt and mixer drive motors are energised and upon, the load cells on each of the respective weigh hoppers (22, 23; 24,25; 26,27; 28,29; 53, 54) indicating the accumulation of a mass of material in the hoppers equal to the pre-set value, signals are originated to effect closing the respective solenoid actuated valves. Upon the signals from all of the hoppers indicating that the loadings of material in the selected hoppers are proportionately in accordance with the required recipe, further signals are originated by the controller to effect appropriate energisation of one of each pair of the vibratory and screw feeders (32, 33; 34, 35; 36,37; 38,39 and 56,58) and appropriate opening of a delivery valve in the water supply to deliver the materials to the inlet of the mixer 48. Delays are applied to the delivery of material from the hoppers 4, 6, 8 and 50 subsequent to the first hopper 2 in order that a homogenous mixture is supplied to the inlet of the mixer, the delays on the weigh hoppers fed by the storage hoppers 4, 6, 8 being on a time basis dependant upon the speed of the feed conveyor belt 40, whilst the supply of cement and of water is initiated upon a device detecting arrival of the aggregate and sand adjacent the inlet to the mixer 48. The various discharge rates from the weigh hoppers are monitored by signals originated by the respective load cells and compared in the controller with set point values which would achieve simultaneous emptying of the weigh hoppers, allowing the appropriate delays. Any divergence between the actual rate and the target rate of discharge is monitored and a signal effecting an appropriate alteration in the speed of the feeders is originated to restore the required proportionality.

Whilst the first set comprising one of each pair of weigh hoppers is delivering material, the remaining weigh hoppers are filled to the required loadings and when the associated weigh hopper is empty the feed function is transferred to the full hoppers and the sequence repeated. Thus the materials, blended in the required proportions, are delivered continuously to the mixer at a set rate, which rate is alterable down to about 50% of full rate almost instantaneously, by adjusting a potentiometer in the controller. An alarm circuit is provided to give warning of divergence of the discharge rates from the set rates by more than ½% and, should divergence occur of a greater amount, to halt the plant. As a further safeguard, timers are incorporated in differentiation circuits receiving input signals from the load cells on the discharging hoppers such that if a discharge rate, derived from the input signals, falls below a predetermined value for longer than a predetermined time interval, the plant is brought to a halt.

I claim:

1. A mixing plant having a series of weigh hoppers each mounted on respective load cell means giving continuous indications of the mass of material within the associated weigh hopper, storage hoppers arranged to deliver material to pairs of weigh hoppers to charge the weigh hoppers alternately, variable speed feeder means associated with each weigh hopper arranged to discharge material from respective alternating, charged, weigh hoppers of each pair to a continuous mixer, individual controller means arranged to vary speeds of the respective variable speed feeder means in accordance with signals generated from effecting comparisons during discharge of the weigh hoppers between indications produced by the load cell means and set point values determined in accordance with a continuously variable desired proportioning of the delivery of materials to the continuous mixer and a desired output rate of the continuous mixer from a range of output rates.

* * * * *